US009115952B2

(12) United States Patent
Cole

(10) Patent No.: US 9,115,952 B2
(45) Date of Patent: Aug. 25, 2015

(54) FIREARM CONVERSION SYSTEM AND METHOD

(71) Applicant: Matthew J. Cole, Las Vegas, NV (US)

(72) Inventor: Matthew J. Cole, Las Vegas, NV (US)

( * ) Notice: Subject to any disclaimer, the term of this patent is extended or adjusted under 35 U.S.C. 154(b) by 0 days.

(21) Appl. No.: 14/584,092

(22) Filed: Dec. 29, 2014

(65) Prior Publication Data

US 2015/0159974 A1 Jun. 11, 2015

Related U.S. Application Data

(62) Division of application No. 13/970,871, filed on Aug. 20, 2013, now Pat. No. 8,925,239.

(51) Int. Cl.
*F41A 35/02* (2006.01)
*F41A 11/00* (2006.01)

(52) U.S. Cl.
CPC ..... *F41A 35/02* (2013.01); *F41A 11/00* (2013.01)

(58) Field of Classification Search
CPC ..... F41A 11/00; F41A 11/02; F41A 11/04; F41A 35/02; F41A 99/00
USPC ..... 42/71.02, 108
See application file for complete search history.

(56) References Cited

U.S. PATENT DOCUMENTS

| | | | | |
|---|---|---|---|---|
| 4,580,484 | A * | 4/1986 | Moore | 89/128 |
| 5,325,617 | A * | 7/1994 | Vojta et al. | 42/75.03 |
| 5,808,229 | A | 9/1998 | Bastian et al. | |
| 6,968,770 | B2 | 11/2005 | Barfield et al. | |
| 7,140,141 | B2 | 11/2006 | Vaid | |
| 2010/0229445 | A1 * | 9/2010 | Patel | 42/6 |

FOREIGN PATENT DOCUMENTS

| | | |
|---|---|---|
| AT | 400197 | 10/1995 |
| EP | 1 584 884 | * 10/2005 |

OTHER PUBLICATIONS

Lone Wolf Glock Parts & Accessories, http://www.lonewolfdist.com/products.aspx?CAT=225, 2 pages, Copyrighted 2014 by Lone Wolf Distributors, printed on Jan. 24, 2014.

* cited by examiner

*Primary Examiner* — Stephen M Johnson
(74) *Attorney, Agent, or Firm* — Weide & Miller, Ltd.

(57) ABSTRACT

Methods and systems are provided for modifying a firearm, including a kit for creating a modified handgun from first and second handguns. In one embodiment of the invention, a modified handgun is created which comprises a slide and barrel from a first handgun and a frame of a second handgun, using a kit comprising a dust cover insert, a replacement recoil spring and a replacement recoil spring guide.

10 Claims, 3 Drawing Sheets

FIREARM CONVERSION SYSTEM AND METHOD

RELATED APPLICATION DATA

This application is a divisional of U.S. patent application Ser. No. 13/970,871, filed Aug. 20, 2013, now U.S. Pat. No. 8,925,239.

FIELD OF THE INVENTION

The present invention relates to firearms and, more particularly, modifications to handguns.

BACKGROUND OF THE INVENTION

Firearm manufactures make a variety of styles of firearms, including handguns. However, serious firearm users and firearm enthusiasts still find that the various firearms on the market do not always satisfy their needs and/or desires. Firearm users may thus modify existing firearms.

For example, Glock sells 9 mm handguns in a 17L or full size, a 19L or compact size, and a 26L or sub-compact size. A user might desire the lower weight and smaller frame size of the 26L handgun, but desire to retain the length of the 17L barrel. Such a user might attempt to cut down the frame of a 19L to a 26L size or attempt to modify a 26L with a longer barrel. Such modifications are generally very difficult and permanently modify the gun(s).

A convenient and cost-effective method and system for modifying one or more firearms is desired.

SUMMARY OF THE INVENTION

Embodiments of the invention comprise methods and systems for modifying or converting a firearm. In embodiment, a kit is provided for creating a modified handgun from first and second handguns.

One embodiment of the invention is a method of creating a modified handgun from a first handgun having a first frame and a first slide and barrel assembly comprising a first slide and first barrel, a first recoil spring and a first recoil spring guide, and a second handgun having a second frame and a second slide and barrel assembly comprising a second slide and second barrel, a second recoil spring, and a second recoil spring guide. The method preferably comprises the steps of creating a modified first slide and barrel assembly comprising connecting a dust cover insert to the first slide and replacing the first coil spring and second recoil spring guide with a third recoil spring and third recoil spring guide, and connecting the modified first slide and barrel assembly to the second frame in replacement of the second slide and barrel assembly.

Another embodiment of the invention comprises a kit for creating a modified handgun from a first handgun having a first frame and a first slide and barrel assembly comprising a first slide and first barrel, a first recoil spring and a first recoil spring guide, and a second handgun having a second frame and a second slide and barrel assembly comprising a second slide and second barrel, a second recoil spring, and a second recoil spring guide comprising a dust cover connectable to the first slide, a replacement recoil spring guide configured to be connected to the first slide in replacement of the first recoil spring guide, and a replacement recoil spring configured to be mounted on the replacement recoil spring guide in replacement of the first recoil spring.

In accordance with one embodiment of the invention, a modified handgun may be created which comprises a slide and barrel from a first handgun and a frame of a second handgun. Preferably, the slide and barrel from the first handgun are longer than the slide and barrel which are normally used with the second handgun, whereby the modified handgun as a smaller frame than the first handgun but a longer slide and barrel than the second handgun. This results in a handgun which weighs less than the first handgun but which has improved accuracy over the second handgun (owing to the longer barrel).

Further objects, features, and advantages of the present invention over the prior art will become apparent from the detailed description of the drawings which follows, when considered with the attached figures.

DETAILED DESCRIPTION OF THE INVENTION

In the following description, numerous specific details are set forth in order to provide a more thorough description of the present invention. It will be apparent, however, to one skilled in the art, that the present invention may be practiced without these specific details. In other instances, well-known features have not been described in detail so as not to obscure the invention.

One embodiment of the invention is a method and system for modifying one or more firearms. In a preferred embodiment of the invention, a slide and barrel assembly from a first handgun is mounted upon a frame of a second handgun, creating a modified handgun.

The present invention has particular utility to the Smith & Wesson™ military and police (or M&P™) line of 9 mm and 40 caliber handguns. However, the invention is not limited to these firearms and may be used with other firearms, including other handguns, as applicable.

Figure 1:
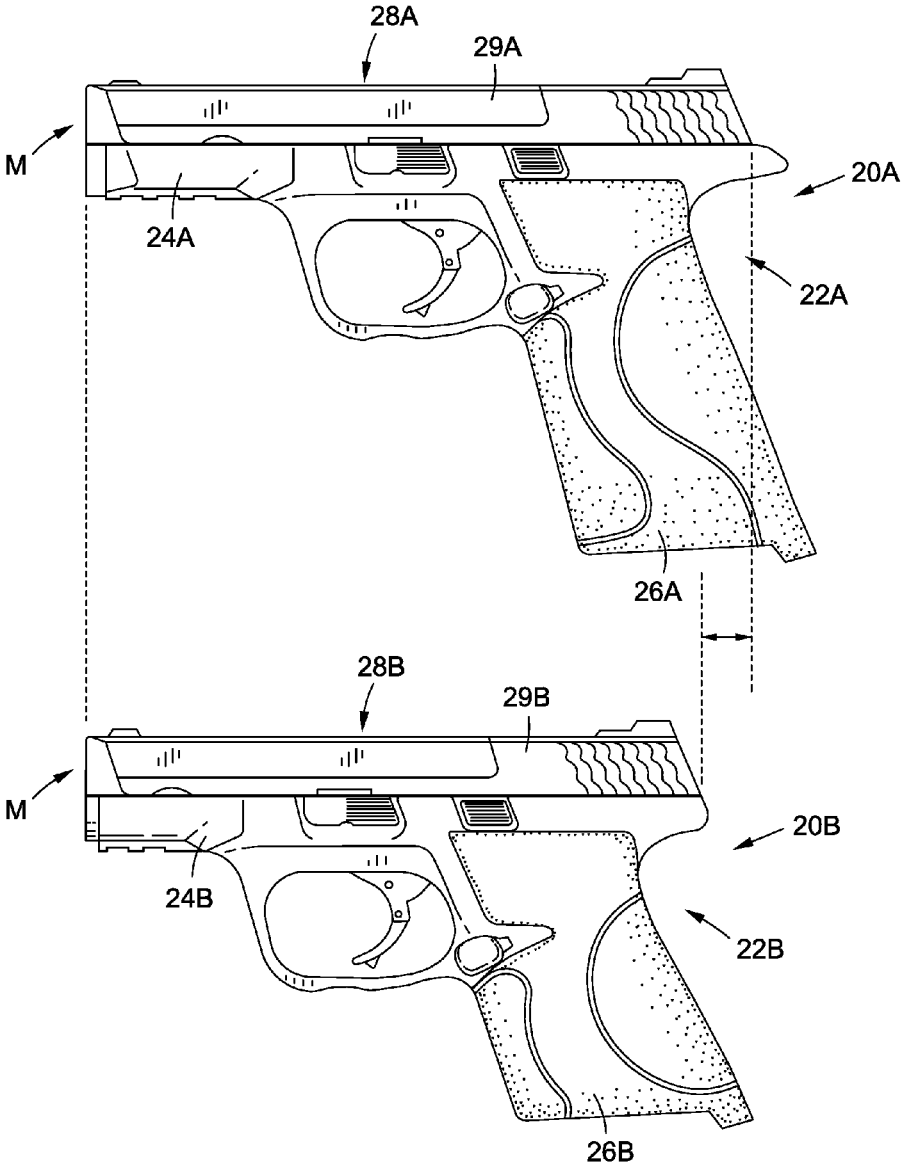
FIG. 1 illustrates a first handgun and a second handgun.

One embodiment of the invention will be described with reference to FIGS. 1-7. FIG. 1 illustrates a first handgun 20A and a second handgun 20B. Preferably, the two handguns have one or more portions with differing dimensions. In a preferred embodiment, the dimensions of slide/barrel assemblies and/or frames of the two handguns 20A, 20B vary.

As one example, the first handgun 20A may comprise a Smith & Wesson™ M&P™ 9 mm full size handgun having a 4.25 inch slide/barrel assembly, whereas the second handgun 20B may comprise a Smith & Wesson™ M&P™ 9 mm compact size handgun having a shorter 3 inch slide/barrel assembly.

The handguns 20A,20B are preferably of a standard configuration and are thus not described in detail herein, as the details of such are readily known to those of ordinary skill in the art. In general, the first handgun 20A has a frame 22A. In general, the frame 22A has a slide/barrel mounting portion 24A and a handgrip portion 26A. The frame 22A includes a mounting interface which includes mounting rails and lugs (not shown). Attached to the mounting rails of the frame 22A is a slide and barrel assembly 28A. The slide and barrel assembly 28A comprises a slide 29A and a barrel (not visible). The slide and barrel assembly 28A is mounted to the frame 22A and extends along a first axis. The barrel defines a projectile passage through which projectiles are launched. The barrel has a first or proximal and a second muzzle or distal end M. Projectiles are fed into the proximal end of the barrel and are launched from the muzzle end.

The slide 29A similarly has a first or proximal end and second distal or muzzle end. The slide 29A preferably extends over the barrel, such as by defining a barrel passage for accepting at least a portion of the barrel. The slide and barrel assembly 28A is preferably mounted for linear movement along the first axis relative to the frame 22A. By the term "along" the first axis, it is meant that the slide and associated barrel move in a linear path parallel to an axis which extends along/parallel to the length of the frame 22A.

The second handgun 20B has a similar configuration, having a frame 22B, a slide/barrel mounting portion 24B, a handgrip portion 26B, a slide and barrel assembly 28B which includes a slide 29B and a barrel.

In the illustrated configuration, the frame 22A of the first handgun 20A is generally larger than the frame 22B of the second handgun 20B, including in both overall length (from a front end to a rear end) and in the size of the handgrip portion 26A,B. In addition, the slide and barrel assembly 28A of the first handgun 20A is longer than the slide and barrel assembly 28B of the second handgun 20B. As indicated above, relative to the above described handguns, the slide and barrel assembly 28A of the first handgun 20A may be about 4.25 inches long, while the slide and barrel assembly 28B of the second handgun 20B is only about 3 inches long.

In accordance with one embodiment of the invention, a method and system is provided by which the handguns may be modified, such as by using parts or components from both handguns to create a third or modified handgun.

Figure 2:
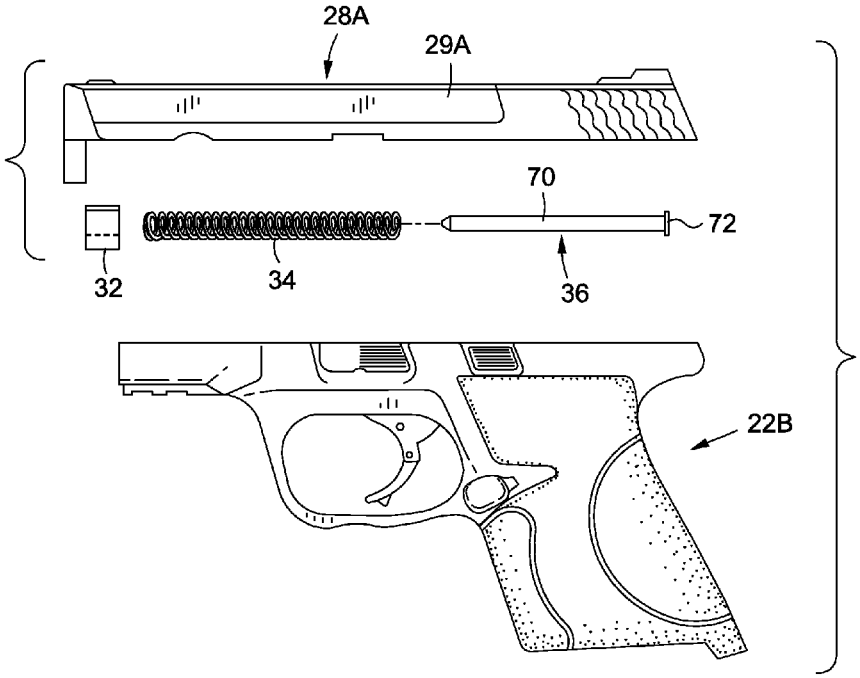
FIG. 2 illustrates a slide and barrel assembly from a first handgun for use with a frame of a second handgun, as well as an insert, recoil spring and recoil spring guide in accordance with the present invention.

In a most preferred embodiment, the slide and barrel assembly 28A from the first handgun 20A is mounted to and used with the frame 22B of the second handgun 20B. Referring to FIG. 2, in one embodiment the slide and barrel assembly 28A of the first handgun 20A is removed from the frame 22A of the first handgun 20A. The slide and barrel assembly 28B of the second handgun 20B is removed from the frame 22B of the second handgun 20B. In one embodiment, the slide and barrel assembly 28A of the first handgun 20A is mountable upon the frame 22B of the second handgun 20B via a kit, which kit preferably comprises an insert 32, a replacement recoil spring 34 and a replacement recoil spring guide 36.

Figure 3:
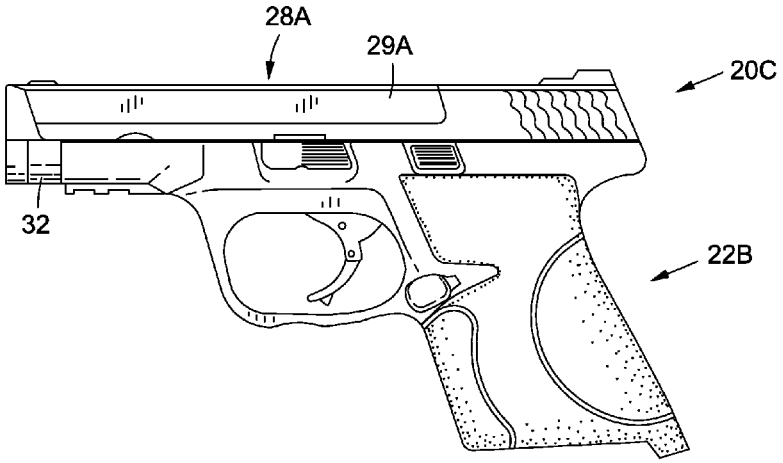
FIG. 3 illustrates a modified handgun in accordance with the present invention.

In one embodiment, the insert 32, recoil spring 34 and recoil spring guide 36 guide are mounted to the slide 29A of the first handgun 20A to create a modified slide and barrel assembly, and then the modified slide and barrel assembly is in turn mounted to the frame 22B of the second handgun 20B, thus creating a modified handgun 20C, as best illustrated in FIG. 3.

Figure 5:
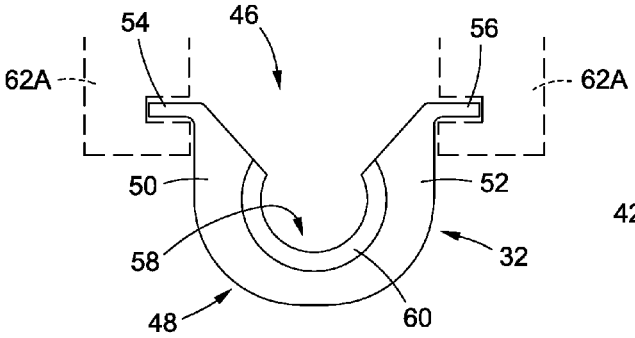
FIGS. 5-7 illustrate a dust cover insert in accordance with an embodiment of the invention.
Figure 6:
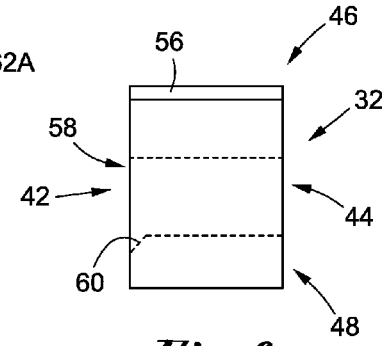
Figure 7:
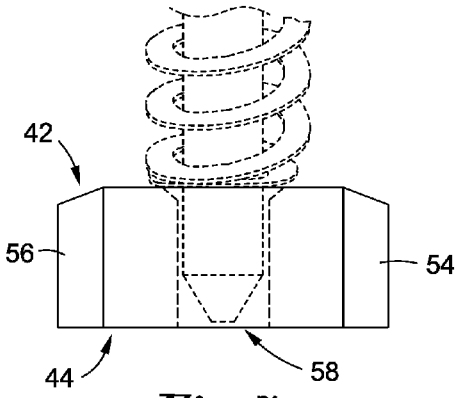

In one embodiment, the insert 32 is configured to mount to the slide 29A and be positioned between a muzzle end of the frame 22B and a dust cover portion 38A of the slide 29A. One embodiment of the insert 32 is illustrated in FIGS. 5-7. As illustrated therein, the insert 32 comprises a body having a first end 42, an opposing second end 44, a top 46 and a bottom 48. The insert 32 is generally "U" or arched shaped, thus generally having a pair of opposing legs 50,52. The legs 50,52 are separated at the top 46 of the insert 32 and connected at the bottom 48 of the insert 32.

At the top 46 of the insert, a pair of feet or mounts 54,56 extend outwardly (in generally opposing directions and in a plane) for engagement with the mounting rails of a handgun slide. The insert 32 defines a channel 58 for accepting the recoil spring guide 36. In the embodiment which is illustrated, the channel 58 is located between the legs 50,52. As illustrated, a top surface of each leg 50,52 preferably slopes downwardly from its respective mount 54,56 to a generally cylindrical portion of the channel 58.

In one embodiment, a seat 60 is defined at the channel 58 at the first end 42 of the insert 32. The seat 60 comprises a recessed portion of the channel 58.

Figure 4:
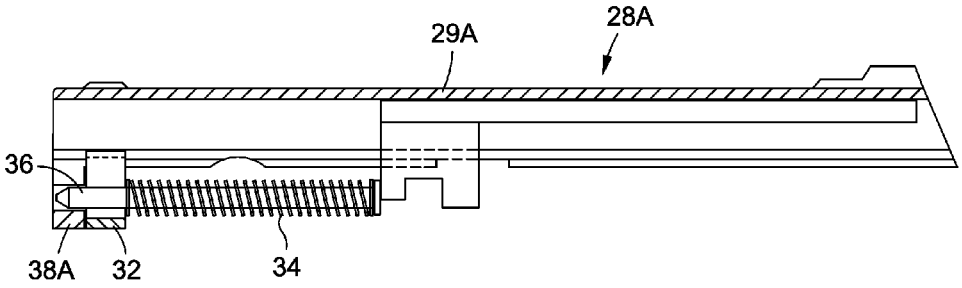
FIG. 4 illustrates a slide and barrel assembly from a first handgun as modified with an insert, recoil spring and recoil spring guide of the present invention.

In use, the existing recoil spring and recoil spring guide (not shown) which are associated with the slide 29A of the first handgun 20A are removed. The mounts 54,56 of the insert 32 are preferably located in slots defined by rails 62A (see FIG. 5) of the slide 29A, with the main body of the insert 32 located between the rails 62A. The insert 32 is preferably positioned next to the existing dust cover 38A of the slide 29A, as best illustrated in FIG. 4.

Preferably, the replacement recoil spring 34 and replacement recoil spring guide 36 are utilized with the insert 32. In one embodiment, the recoil spring guide 36 comprises a pin or rod 70 and a head or mounting portion 72. Preferably, the head 72 is located at one end of the rod 70 opposite a free end thereof. The opposing end is preferably tapered. The head 72 is configured to engage a mount of the slide 29A. In one embodiment, the replacement recoil spring guide 36 is substantially similar to a recoil spring guide of the first handgun 20A, except that it is shorter and has a tapered free end, and is substantially similar to a recoil spring guide of the second handgun 20B, except that it is longer and has a tapered free end.

The recoil spring 34 preferably comprises a coil spring having a first end and a second end. The recoil spring 34 is substantially similar to a recoil spring of the first handgun 20A, except that it is shorter, and is substantially similar to a recoil spring of the second handgun 20B, except that it is longer. Preferably, however, the spring rate of the replacement recoil spring 34 is the same or approximately the same as the recoil spring of the first handgun 20A.

In use, the replacement recoil spring 34 is positioned on the replacement recoil spring guide 36. The head 72 of the recoil spring guide 36 is connected to the slide 29A, with the free end of the pin 70 extending through the channel 58 in the insert 32 and thereon into the dust cover 38A portion of the slide 29A. At the time, a second end of the recoil spring 34 is preferably seated in/against the seat 60 of the insert 32.

Next, the modified slide and barrel assembly 28A (which includes the insert 32, replacement recoil spring 34 and replacement recoil spring guide 36) are connected to the frame 22B of the second handgun 20B, using the connecting rails and mounting lugs, as is known in the art. The completed modified handgun 20C appears as shown in FIG. 3. As indicated, the insert 32 serves to extend the dust cover portion 38A of the first slide and barrel assembly 28A to the frame 22B. The replacement recoil spring 34 and replacement recoil spring guide 36 cause the slide and barrel assembly 28A from the first handgun 20A to be operable with the frame 22B of the second handgun 20B.

The invention has a number of advantages. In accordance with an embodiment of the invention, a modified handgun is created which comprises a slide and barrel from a first handgun and a frame of a second handgun. Preferably, the slide and barrel from the first handgun are longer than the slide and barrel which are normally used with the second handgun, whereby the modified handgun as a smaller frame than the first handgun but a longer slide and barrel than the second handgun. This results in a handgun which weighs less than the first handgun but which has improved accuracy over the second handgun (owing to the longer barrel).

As indicated, the invention may be implemented relative to a number of different handguns. In one embodiment, the invention is implemented relative to the standard and compact versions of the Smith & Wesson Military and Police 9 mm handguns or the standard and compact versions of the Smith & Wesson Military and Police 40 caliber handguns. These pairs of handguns have the advantage that the interfaces between the slides/barrels and the frames of the pairs of handguns are the same, permitting the slide and barrel from one handgun to be mounted on the other gun. In accordance with the present invention, the slide and barrel from one of these handguns can be mounted on the other and made workable using the method and system of the present invention.

It will be understood that the above described arrangements of apparatus and the method there from are merely illustrative of applications of the principles of this invention and many other embodiments and modifications may be made without departing from the spirit and scope of the invention as defined in the claims.

What is claimed is:

1. A kit for creating a modified handgun from a first handgun having a first frame and a first slide and barrel assembly comprising a first slide and first barrel, a first recoil spring and a first recoil spring guide, and a second handgun having a second frame and a second slide and barrel assembly comprising a second slide and second barrel, a second recoil spring, and a second recoil spring guide, wherein said first slide and barrel assembly is modified and connected to said second frame in replacement of said second slide and barrel assembly, said kit comprising:

a dust cover insert connectable to said first slide;

a replacement recoil spring guide configured to be connected to said first slide in replacement of said first recoil spring guide; and a replacement recoil spring configured to be mounted on said replacement recoil spring guide in replacement of said first recoil spring, whereby said kit is configured to create a modified first slide and barrel assembly which is connectable to said second frame in replacement of said second slide and barrel assembly.

2. The kit in accordance with claim 1 wherein said first slide has mounting rails and said dust cover insert is generally "U" shaped and has first and second mounts which engage said mounting rails.

3. The kit in accordance with claim 1 wherein said replacement recoil spring is longer than said second recoil spring and shorter than said first recoil spring.

4. The kit in accordance with claim 1 wherein said replacement recoil spring guide is longer than said second recoil spring guide and shorter than said second recoil spring guide.

5. The kit in accordance with claim 4 wherein said replacement recoil spring guide comprises a rod having a head located at a first end and a second tapered end.

6. The kit in accordance with claim 1 wherein said first recoil spring has a first length and said second recoil spring has a second length different than said first length.

7. the kit in accordance with claim 1 wherein said first recoil spring guide has a first length and said second recoil spring guide has a second length different than said first length.

8. The kit in accordance with claim 1 wherein said first slide and barrel assembly has a first length and said second slide and barrel assembly has a second length.

9. The kit in accordance with claim 8 wherein said dust cover insert has a length equal to the difference between said first length and said second length.

10. The kit in accordance with claim 1 wherein said first handgun comprises a Smith & Wesson Military and Police model 9 mm standard and said second handgun comprises a Smith & Wesson Military and Police model 9 mm compact.

* * * * *